US011484454B2

(12) United States Patent
Smith

(10) Patent No.: US 11,484,454 B2
(45) Date of Patent: Nov. 1, 2022

(54) ROTATABLE BATH SEAT WITH LINEAR ACTUATOR

(71) Applicant: Platinum Health, LLC, Orlando, FL (US)

(72) Inventor: Randall L. Smith, Orlando, FL (US)

(73) Assignee: Platinum Health, LLC, Orlando, FL (US)

( * ) Notice: Subject to any disclaimer, the term of this patent is extended or adjusted under 35 U.S.C. 154(b) by 0 days.

(21) Appl. No.: 17/233,823

(22) Filed: Apr. 19, 2021

(65) Prior Publication Data

US 2021/0330529 A1 Oct. 28, 2021

Related U.S. Application Data

(60) Provisional application No. 63/016,021, filed on Apr. 27, 2020.

(51) Int. Cl.
*A61G 7/10* (2006.01)
*A47K 3/12* (2006.01)

(52) U.S. Cl.
CPC ..... *A61G 7/1003* (2013.01); *A47K 3/125* (2013.01)

(58) Field of Classification Search
CPC ..... A47K 3/125; A61G 7/1003
USPC ..... 4/559, 560.1, 562.1
See application file for complete search history.

(56) References Cited

U.S. PATENT DOCUMENTS 3,802,421 A * 4/1974 Williams ..... A47K 3/001 15/88.4
4,253,203 A * 3/1981 Thomas ..... A61G 7/1059 4/612
5,898,959 A * 5/1999 Ricker ..... A61G 7/0005 4/604
5,903,935 A * 5/1999 Huelke ..... A47K 3/122 4/578.1
5,940,905 A * 8/1999 Cheng ..... A47K 3/122 4/578.1
6,182,304 B1 * 2/2001 Freeberg ..... A47K 3/122 4/578.1
6,334,225 B1 * 1/2002 Brinkmann ..... A61G 7/1067 4/578.1
6,681,415 B1 * 1/2004 Gallo ..... A47K 3/122 4/578.1
10,722,033 B1 * 7/2020 Chen ..... A47C 3/18
2006/0236449 A1 * 10/2006 Hammer ..... A61G 7/1003 4/560.1
2008/0148473 A1 * 6/2008 Cheng ..... A61G 7/1034 4/578.1
2009/0025136 A1 * 1/2009 Cheng ..... A47K 3/122 4/560.1

(Continued)

*Primary Examiner* — Benjamin R Shaw
(74) *Attorney, Agent, or Firm* — McHale & Slavin, P.A.

(57) ABSTRACT

Disclosed is a movable bath seat device employing a linear actuator to assist an individual with decreased mobility in and out of a bathtub. The linear actuator employs a direct current motor with limit switches to move the seat between positions. The device permits an individual to take a position on the seat outside the bathtub and, by use of the actuator, move their torso to a position inside the bath tub side walls. The seat can then rotate, allowing an individual to lift their legs into the bathtub at their convenience. In a preferred embodiment, the cushion on the rotating seat assembly is constructed of a slip resistant padding comprised of medical grade, closed cell molded polyurethane padding that does not absorb water.

14 Claims, 9 Drawing Sheets

(56) References Cited

U.S. PATENT DOCUMENTS

| | | | | |
|---|---|---|---|---|
| 2011/0283449 | A1* | 11/2011 | Baxley | A61G 7/1003 4/560.1 |
| 2011/0289678 | A1* | 12/2011 | Huang | A61G 7/1034 5/81.1 R |
| 2011/0289679 | A1* | 12/2011 | Huang | A61G 7/1034 5/81.1 RP |
| 2017/0015218 | A1* | 1/2017 | Troyer | B60R 22/001 |
| 2017/0088022 | A1* | 3/2017 | Troyer | B60N 2/24 |
| 2018/0055704 | A1* | 3/2018 | Mlungwana | A61G 7/1088 |
| 2018/0178690 | A1* | 6/2018 | Castillo | B60N 2/0244 |
| 2018/0271335 | A1* | 9/2018 | Hart | A61G 7/1034 |
| 2020/0085243 | A1* | 3/2020 | Lin | A61G 5/1072 |

* cited by examiner

ROTATABLE BATH SEAT WITH LINEAR ACTUATOR

PRIORITY CLAIM

In accordance with 37 C.F.R. § 1.76, a claim of priority is included in an Application Data Sheet filed concurrently herewith. Accordingly, the present invention claims the benefit date of U.S. Provisional Patent Application No. 63/016,021, entitled "ROTATABLE BATH SEAT WITH LINEAR ACTUATOR", filed Apr. 27, 2020. The contents of which the above referenced application is incorporated herein by reference.

FIELD OF THE INVENTION

The present invention relates generally to devices used for assisting an individual to get in and out of a bathtub; and more specifically, to a seat having a rotating seat assembly and linear actuator to assist an individual for entering and exiting a bath tub.

BACKGROUND OF THE INVENTION

Loss of independence and privacy in the bathroom can be extremely difficult for those physically injured or disabled, as well as the elderly. A particularly hazardous endeavor in the bathroom is bathing, as many individuals are unable to use a walk-in shower or step into a bathtub. Conventional bathtubs require the traversing over a sidewall of the tub in order to position an individual in an area where proper washing is possible using the tub as a catch basin and drain. Unfortunately, bathtubs are notoriously slippery as the materials of construction are designed to be easily cleaned. Placing tub mats or friction tape onto tub surfaces helps prevent slips and falls, but can trap moisture and become a breeding ground for bacteria.

Those with diminished mobility may resort to grasping tub seats, towel bars, and other bathroom fixtures with disastrous results. Slip and falls in the bathtub are a major problem for individuals as they attempt to enter or exit the bathtub. It is a top priority to protect the disabled and elderly population when bathing.

Bath seats are known in the industry, including a seat that can rotate. However, many individuals still have difficulty moving the seat from an out-of-tub position to an in-tub position.

Accordingly, what is needed is an improvement in the bathroom to protect our most vulnerable members of society, namely a bath seat having a rotatable bath seat with a linear actuator.

SUMMARY OF THE INVENTION

The present invention is a rotatable bath seat with linear actuator to safely assist an individual with diminished mobility in and out of a bathtub. The rotating seat is comprised of a base having a recessed cavity with an insert. The seat is configured to be comfortable, functional and capable of withstanding a wet environment.

Accordingly, it is an objective of the instant invention to provide a rotatable seat that can be moved from a position outside a tub wall to a position inside the tub wall by use of a linear actuator.

It is a further objective of the instant invention to provide a rotatable seat surface that is slip resistant when human skin contacts the surface by use of a medical grade slip resistant padding that does not absorb water.

Another objective of the invention is to provide a device that is lightweight and easily installed without tools.

Still another objective of the invention is to provide a device to safely move an individual into a bathtub without the need for friction strips, non-slip mats or the like materials that can trap bacteria, wherein the bathtub can be easily cleaned after use.

Another objective of the invention is to provide a seat transfer device that is adjustable in height to accommodate different sized tub walls.

Yet still another objective of the invention is to provide a rotatable seat with a linear support that can be shipped in preassembled components, allowing final assembly without tools.

Other objectives and advantages of this invention will become apparent from the following description taken in conjunction with any accompanying drawings wherein are set forth, by way of illustration and example, certain embodiments of this invention. Any drawings contained herein constitute a part of this specification, include exemplary embodiments of the present invention, and illustrate various objects and features thereof.

DETAILED DESCRIPTION OF THE INVENTION

Figure 1:
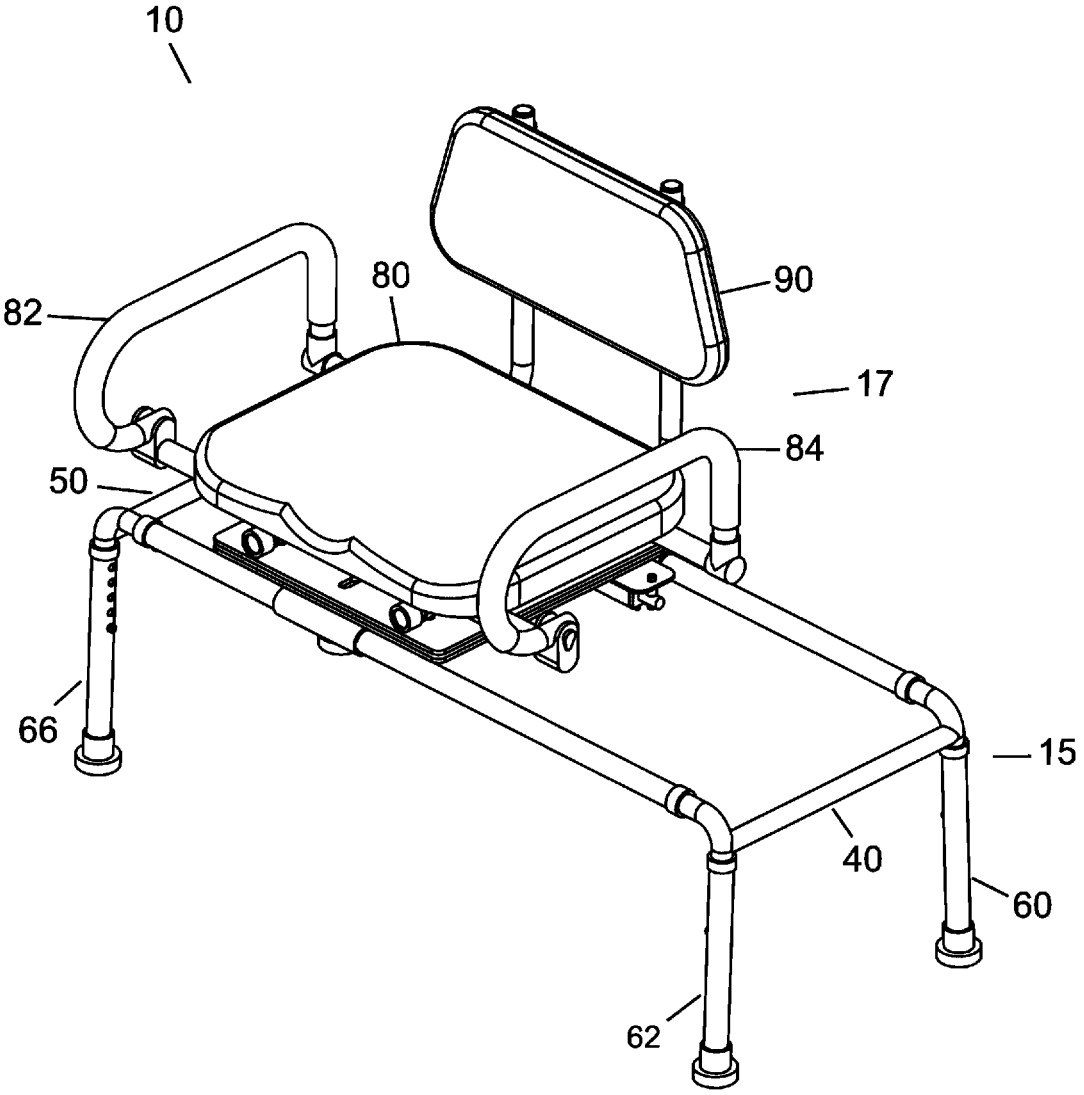
FIG. 1 is an upper perspective view of the present invention.

While the present invention is susceptible of embodiment in various forms, there is shown in the drawings and will hereinafter be described a presently preferred, albeit not limiting, embodiment with the understanding that the present disclosure is to be considered an exemplification of the present invention and is not intended to limit the invention to the specific embodiments illustrated.

Figure 3:
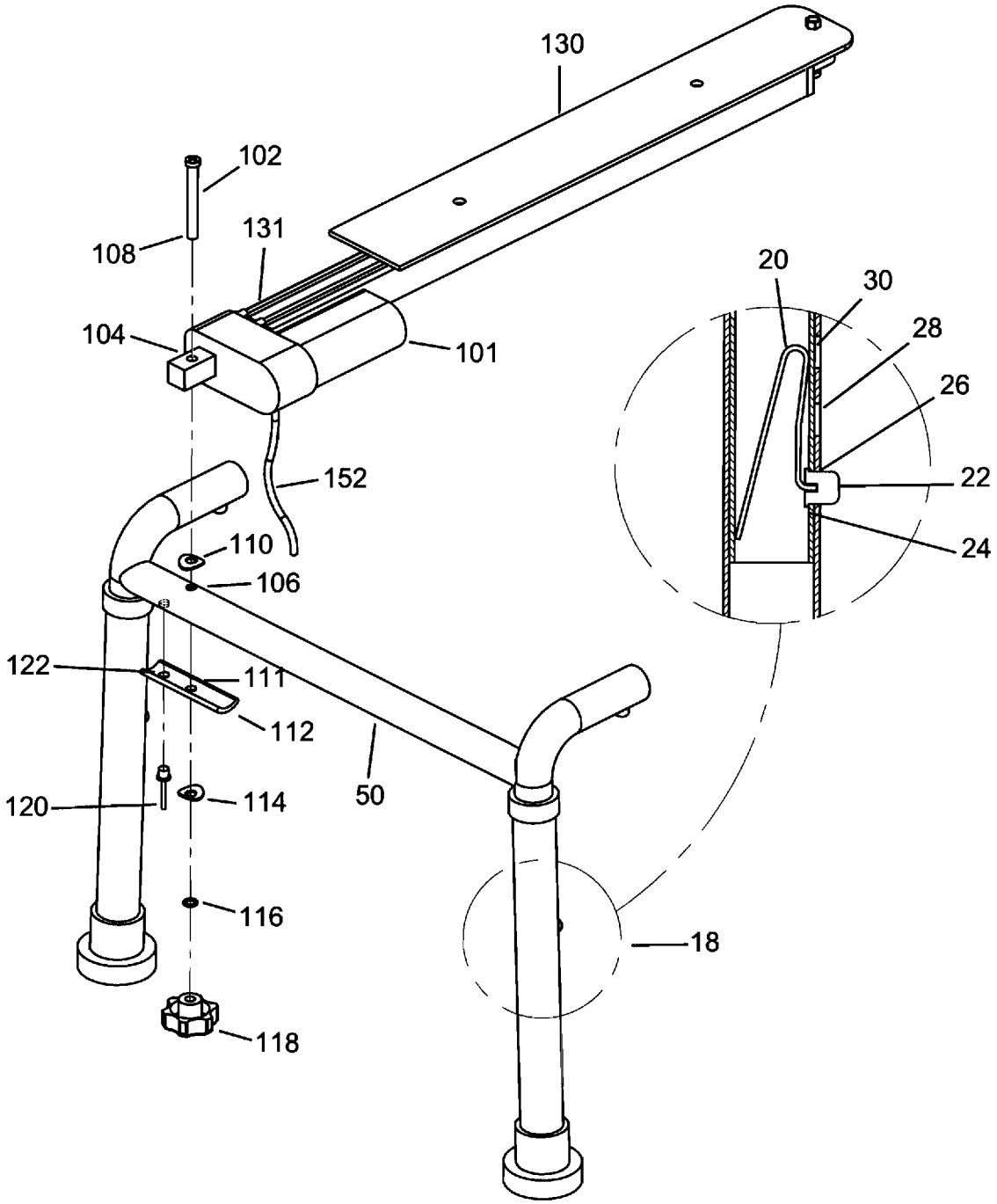
FIG. 3 is an exploded view of the linear actuator and expandable legs.
Figure 4:
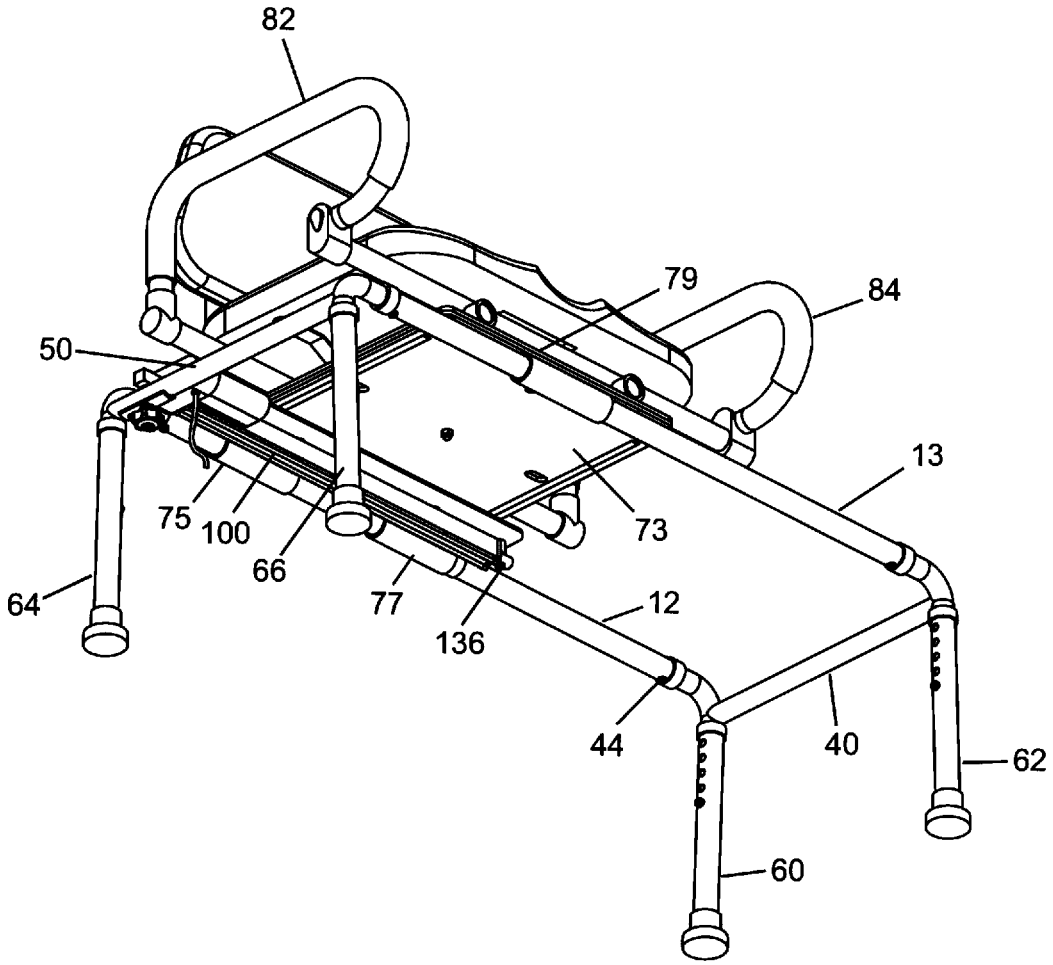
FIG. 4 is a lower perspective view with the chair in a retracted position.

Referring to the figures in general, the rotatable bath seat with linear actuator assembly 10 includes a base support 15 and a seat assembly 17. The base support 15 is formed from a first runner support 12 having a first end 14 and a second end 16 forming a length therebetween. The first end 14 includes a biased detent 18. For ease of explanation, any biased detent 18 referred to in this specification comprises a V-shaped spring 20 formed from spring steel with a movable detent 22 which fits within an aperture 24, as illustrated in FIG. 3, so as to removably couple the first runner support 12 to an elbow assembly 40. A first end 42 of the elbow assembly 40 is insertable into said first runner support 12, wherein an aperture 44 receives the biased detent 18 for securing the first runner support 12 to the elbow assembly 40. A first leg 60 includes a biased detent 18 that allows the first leg 60 to be removably coupled to the elbow assembly 40. For further ease of explanation, second runner support 13 is the same as first runner support 12, and each of the runner supports 12, 13 releasably couple to elbow assemblies 40, 50, elbow assembly 50 forming a mirror image of elbow assembly 40. Legs 60, 62, 64, and 66 each said leg having multiple apertures 26, 28, 30, 32, 34, allowing a leg, or legs to be raised or lowered accordingly. For instance, it is possible that the legs positioned outside a bathtub must be longer than those positioned inside the bathtub to allow the first and second runners 12, 13 to be approximately level.

Figure 2:
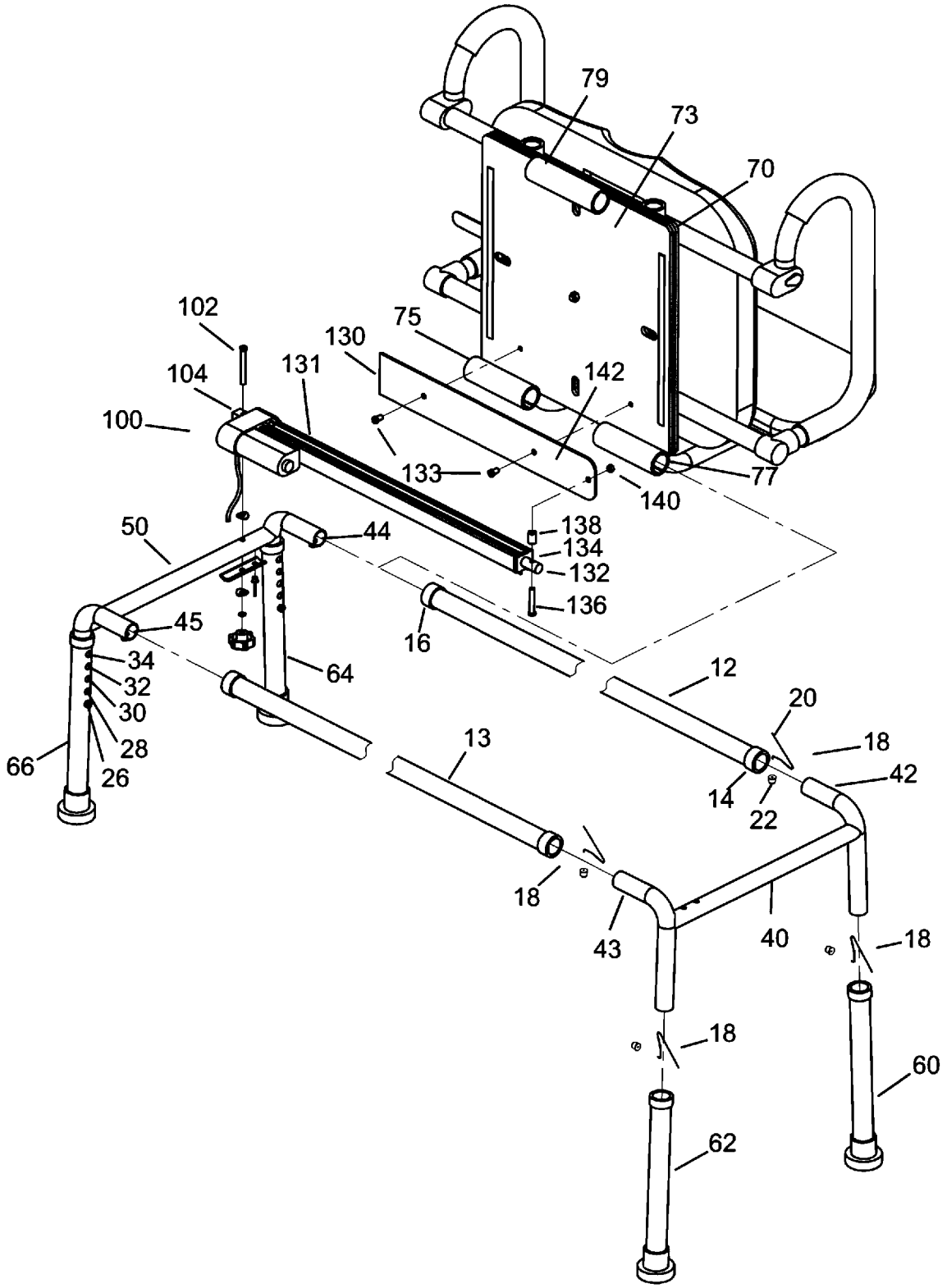
FIG. 2 is an exploded view thereof.

In a similar manner, a second end 43 of the elbow assembly 40 is insertable into said second runner support 13, wherein an aperture 45, as depicted in the second runner support 13, receives a biased detent 18 for securing the runner 13 to the second support elbow 50. A second leg 62 includes a biased detent 18 that allows the second leg 62 to be removably coupled to the elbow assembly 40. As previously stated, second runner 13 is the same as first runner 12, and each of the runners 12, 13 releasably couple to first and second elbow assemblies 40, 50 and legs 60, 62, 64, and 66, each leg having multiple apertures 26, 28, 30, 32, 34, allowing each leg to be raised or lowered accordingly to facilitate leveling of the runners 12, 13. The second elbow assembly 50 having an aperture 44 for engaging a biased detent 18, illustrated in FIG. 2, attaching the runner to elbow assembly 40. Similarly aperture 45 is used to engage a biased detent 18 for attaching the runner 13 to elbow assembly 50.

The seat assembly 17 is formed from a base 70 having an upper plate 72 rotatably secured to a lower plate 74. The upper plate 72 has an upper surface 76 for securing to a seat platform 78, the seat platform 78 having a seat surface 80 that is slip resistant when human skin contacts the surface by use of medical grade slip resistant padding that does not absorb water. Handles 82 and 84 are secured to the seat platform 78, providing an area for an individual to grasp and lift the assembly 10 for removal, or allow an individual support while sitting down. A back rest 90 is elevated by stands 92, 94 to provide lower back support for an individual and allow ease of cleaning after use.

The lower plate 74 bottom surface 73 includes tube slides 75 and 77 that are sized to slidingly receive the first runner support 12, and a tube slide 79 which is sized to slidingly receive the second runner support 13. The tube slides 75, 77, 79 maintain full contact with the runner supports 12, 13 at all times.

A seat lever 85 is used to allow rotation of the seat base 70 in relation to the first and second runner supports 12, 13. The seat lever 85 is used to engage pin 87 to lock the upper plate 72 in position relative to the lower plate 74. The seat lever 85 relies upon a steel spring 89 that is captured in a housing 91. In the preferred embodiment, the lever allows the seat 80 to be locked into a fixed position that is parallel to the runner supports 12, 13, wherein an individual would be situated upon the seat 80 and a fixed position that is perpendicular to the runner supports 12, 13; wherein an individual would have been moved into the tub basin and can freely rotate their legs into the bath tub basin. Alternatively, an individual may rotate their legs outside the tub basin, or rotate the seat at the same time the seat is being moved between positions.

A linear actuator 100 is secured to the second elbow assembly 50 by use of a pin 102 which fits through an actuator mounting aperture 104 and through an elbow aperture 106, see FIG. 3. The pin 102 has a threaded portion 108 that is directed through the elbow aperture 106, engaging an upper washer 110 on the top side of the elbow support 50 through a first aperture 111 on a reinforcement plate 112 and adjoined using a washer 114 engaged with a lock washer 116 and hand grip fastener 118. The hand grip fastener 118 allows ease of assembly without the need for tools. An alignment pin 120 passes through a second aperture 122 on the reinforcement plate 112 for engaging the elbow support 50, the alignment pin 120 preventing torque movement of the linear actuator 100.

Figure 5:
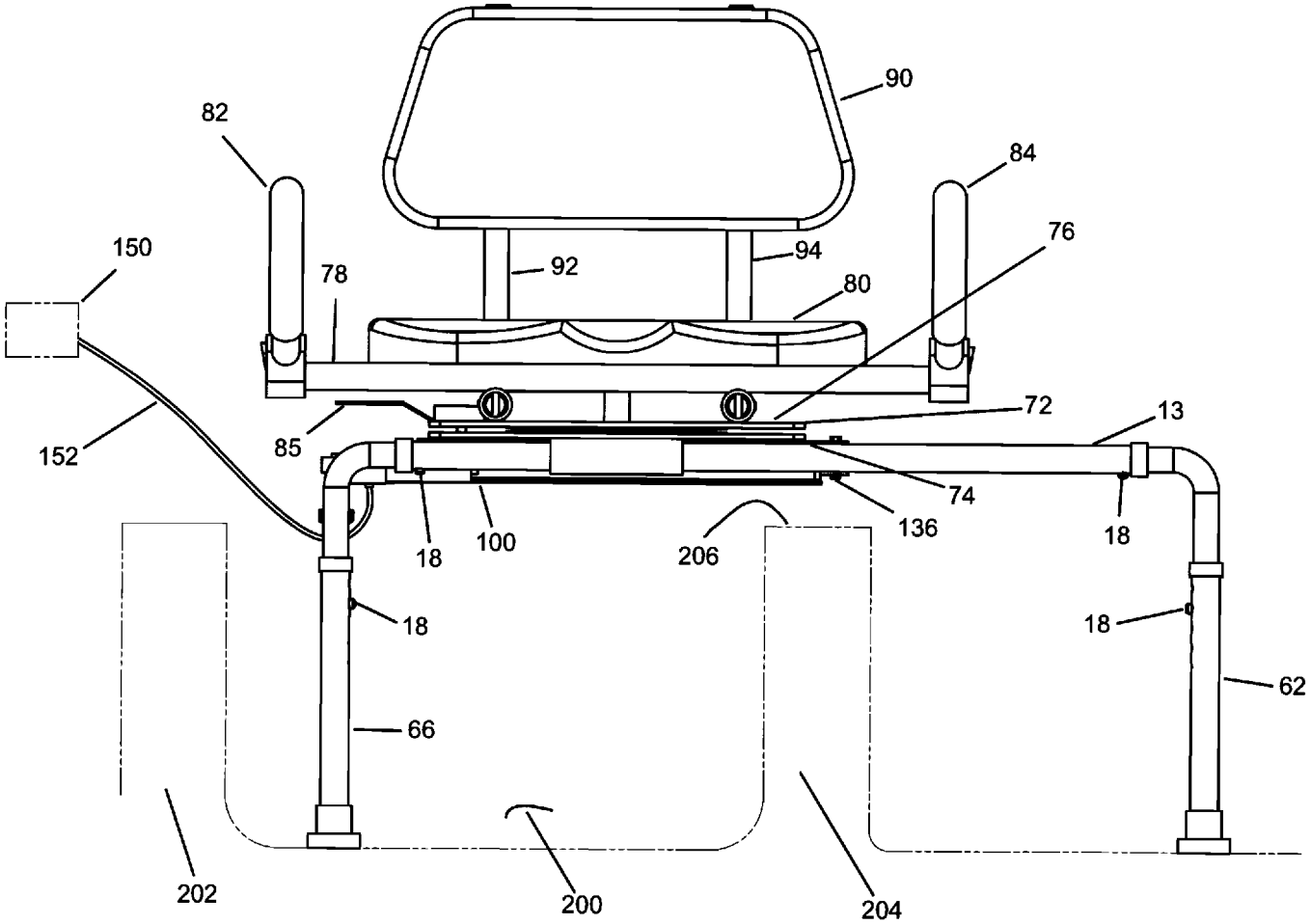
FIG. 5 is a side plane view depicting the chair within a bathtub.
Figure 6:
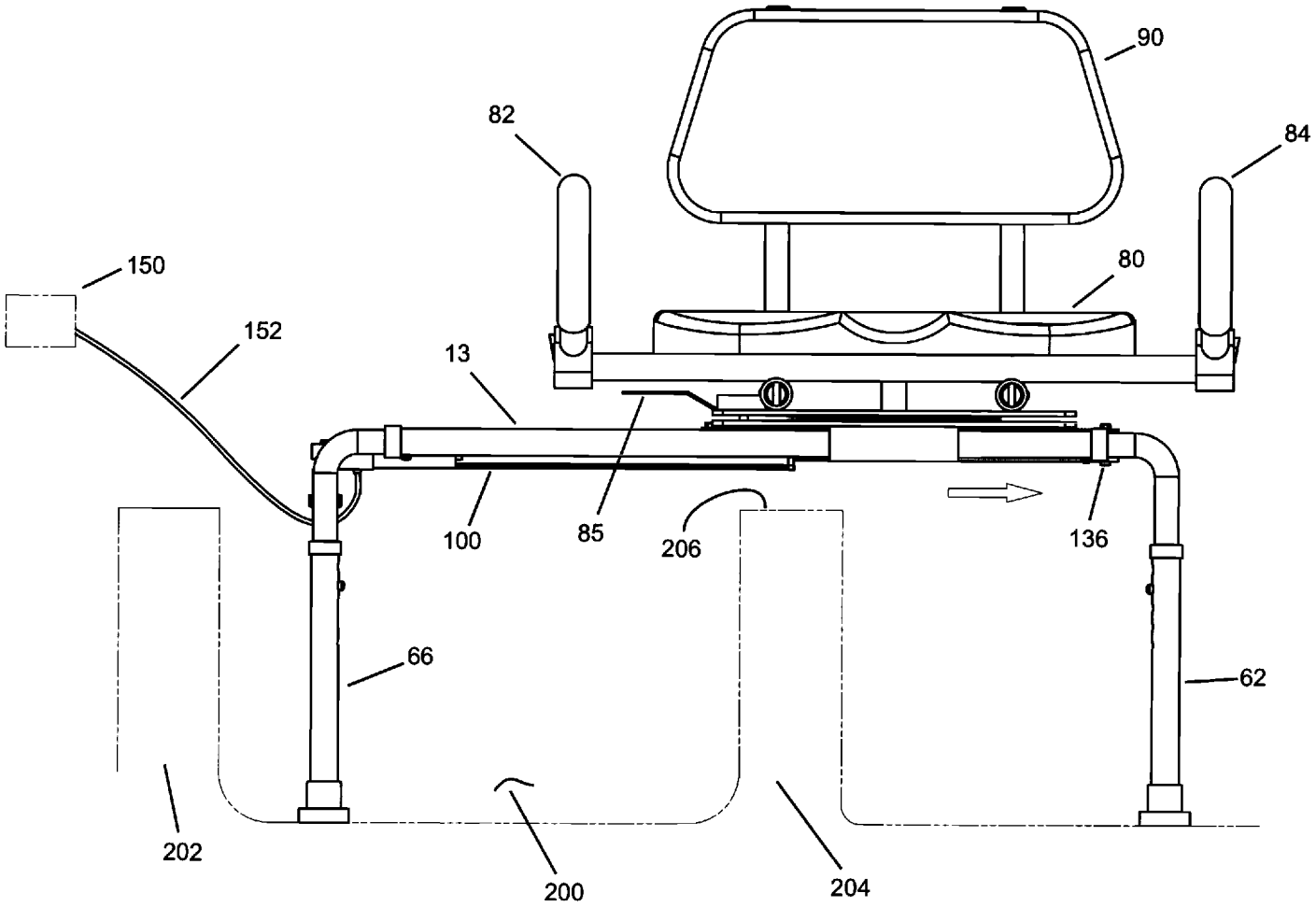
FIG. 6 is a side plane view depicting the chair outside a bathtub.
Figure 7:
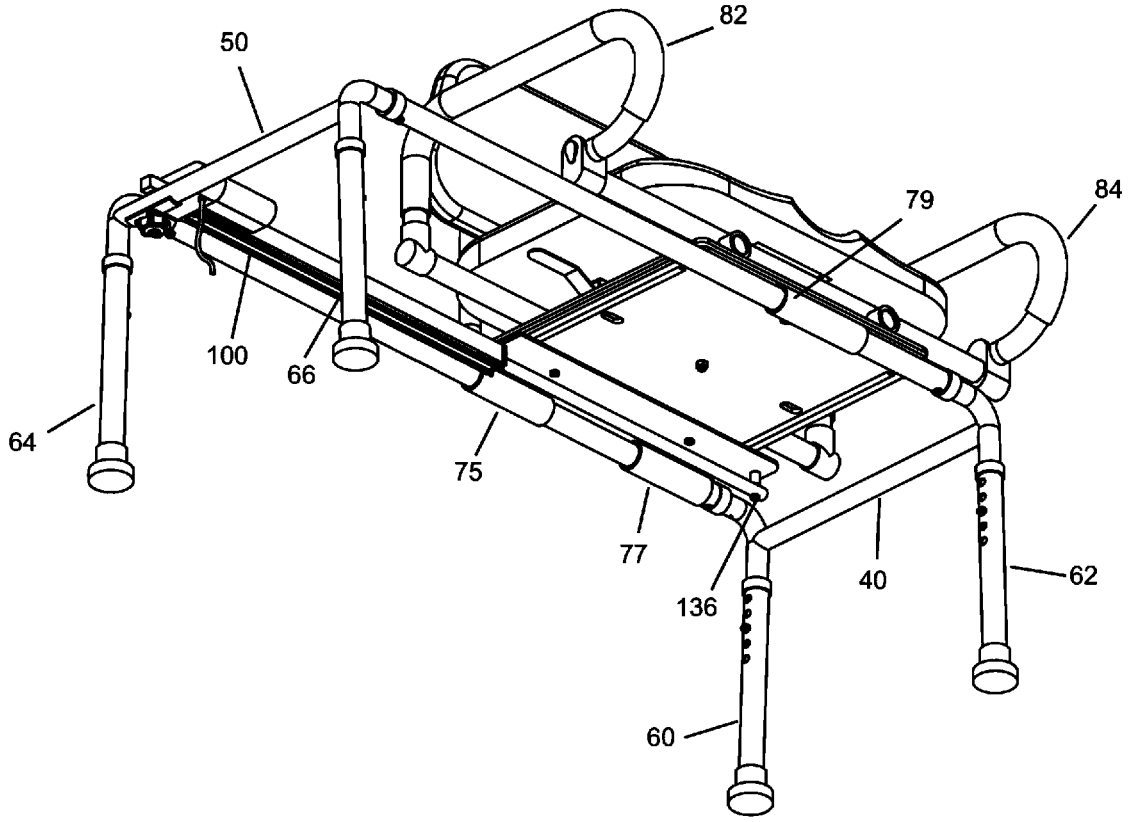
FIG. 7 is a lower perspective view with the chair in a deployed position.
Figure 8:
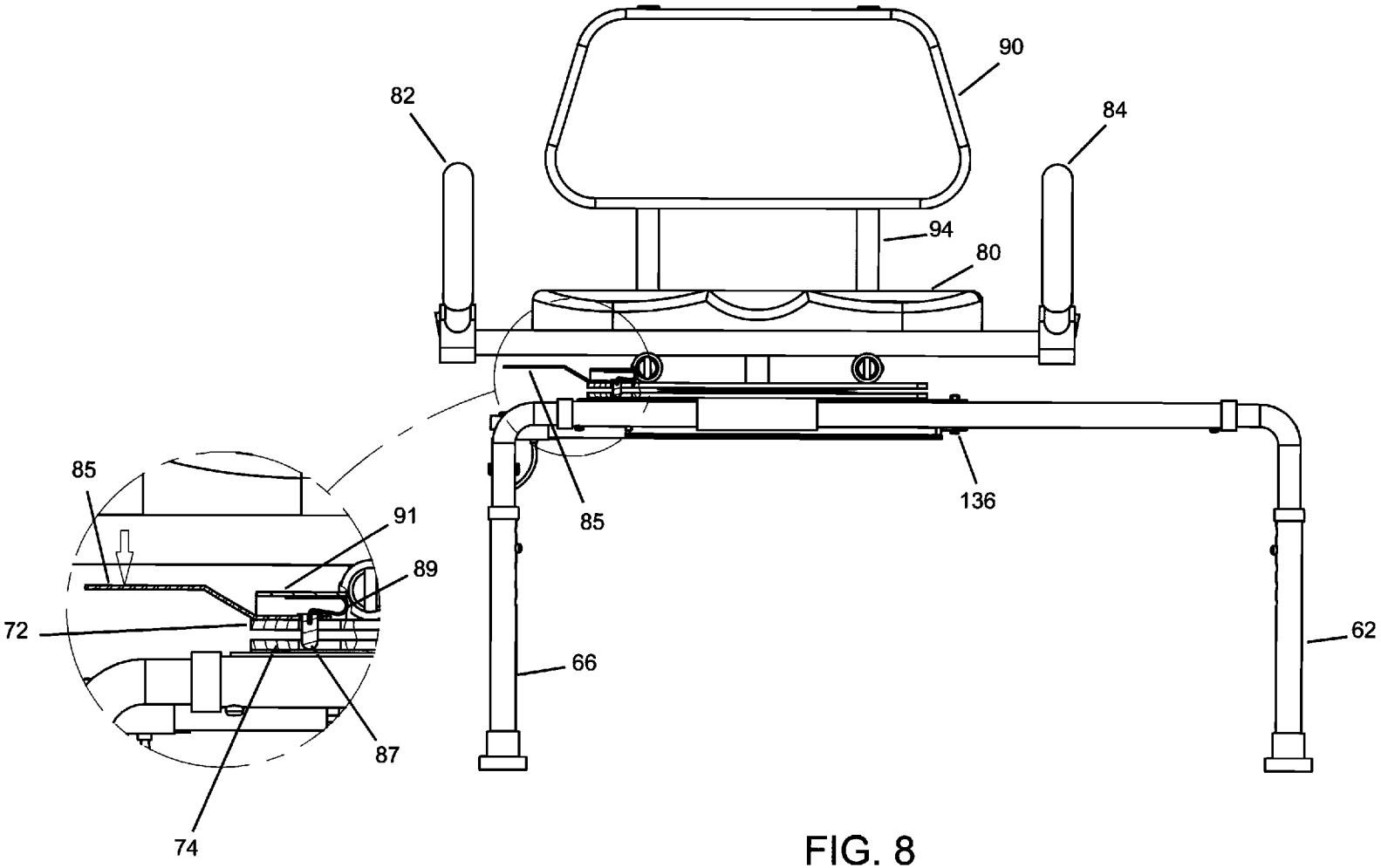
FIG. 8 is a side plane view depicting the hand lever for seat rotation.
Figure 9:
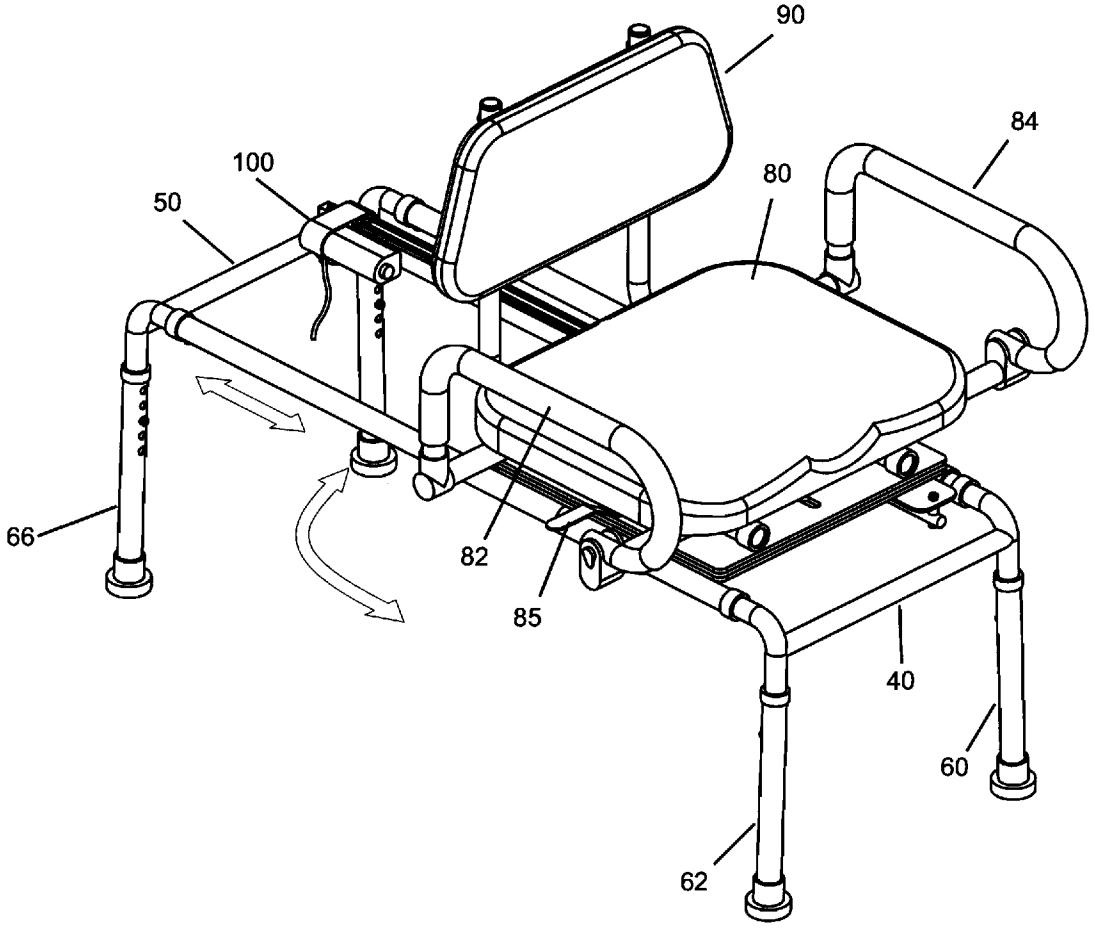
FIG. 9 is an upper perspective view illustrating seat rotation and linear movement.

A mounting plate 130 is positioned above the upper surface 131 of the linear actuator 100. The mounting plate 130 is secured to the bottom surface 73 of the lower plate 74 of the seat assembly base 70 with fasteners 133. The linear actuator 100 preferably employs a 24V DC magnetic motor 101 operating a spindle 132 capable of deployment and retraction. An aperture 134 is formed in the spindle 132 for receipt of a fastener 136 having a spacer 138 between the spindle 132 and the mounting plate 130. The fastener 136 is secured to the mounting plate 130 with a lock nut 140 placed on the backside of a fastening aperture 142. In the preferred embodiment, the linear actuator 100 is secured to the lower plate 74 during the manufacturing stage allowing final assembly to be performed without tools. The actuator 100 illustrated in FIG. 5 is shown in a retracted position. As illustrated, the seat assembly 17 is placed over a bathtub 200 having bathtub walls 202 and 204. Leg 66 is illustrated inside the bathtub 200 with the second support runner 13 positioned above the upper surface 206 of bathtub wall 204. As previously stated, legs 60, 62, 64, and 66 are adjusted by the biased detents 18. The linear actuator spindle 132 is deployed by use of a remote controller 150, which can be coupled wirelessly or by wire 152 as illustrated in FIGS. 5 and 6. In the deployed position, an individual can sit on the seat portion, rotate the seat by a lever 85, and then operate the remote controller 150 so as to place the seat and individual over the bathtub basin. Alternatively an individual can sit on the seat portion, operate the remote controller 150 to position the seat and individual over the bathtub basin, and then rotate the seat by the lever 85.

It is to be understood that while a certain form of the invention is illustrated, it is not to be limited to the specific form or arrangement herein described and shown. It will be apparent to those skilled in the art that various changes may be made without departing from the scope of the invention and the invention is not to be considered limited to what is shown and described in the specification and any drawings/figures included herein.

One skilled in the art will readily appreciate that the present invention is well adapted to carry out the objectives and obtain the ends and advantages mentioned, as well as those inherent therein. The embodiments, methods, procedures and techniques described herein are presently representative of the preferred embodiments, are intended to be exemplary, and are not intended as limitations on the scope. Changes therein and other uses will occur to those skilled in the art which are encompassed within the spirit of the invention and are defined by the scope of the appended claims. Although the invention has been described in connection with specific preferred embodiments, it should be understood that the invention as claimed should not be unduly limited to such specific embodiments. Indeed, various modifications of the described modes for carrying out the invention which are obvious to those skilled in the art are intended to be within the scope of the following claims.

What is claimed is:

1. A bath seat comprising:

a base formed from first and second runner supports maintained in a spaced apart and level position by first and second elbow assemblies and an adjustable leg secured to each said runner support;

a seat assembly having a rotatable base slidably secured to said first and said second runner support, said seat assembly including a seat section and a seat back section positioned perpendicular to said seat section;

a linear actuator having a first end secured to one said elbow assembly and a second end secured to said seat assembly, said linear actuator having a 24V magnetic drive motor for deployment and retraction of said seat assembly along said first and second support runners; and a controller for operating said linear actuator.

2. The bath seat according to claim 1 including a seat lever operatively associated with said rotatable base, said seat lever engaging at least one spring biased pin to lock said seat section in a fixed position.

3. The bathtub chair according to claim 1 wherein said first and second runner supports are releasably secured to said first and second elbow assemblies by use of biased detents.

4. The bathtub chair according to claim 1 wherein said legs are independently adjustable to position said first and second runner supports in a substantially level position.

5. The bathtub chair according to claim 1 wherein said seat section and said back section are constructed of a slip resistant padding.

6. The bathtub chair according to claim 1 wherein said controller is remotely coupled to said linear actuator.

7. The bathtub chair according to claim 1 including a handle positioned adjacent to each side edge of said seat portion.

8. The bathtub chair according to claim 1 wherein said rotatable base includes a first tube slide slidably secured to said first runner support and a second tube slide slidably secured to said second runner support.

9. A bath seat comprising:

a base formed from first and second runner supports, each said runner support releasably secured to first and second elbow assemblies for maintaining said first and second runner supports in a spaced apart position, said first elbow assembly having a first pair of legs to position said first elbow assembly at a first height, said second elbow assembly having a second pair of legs to position said second elbow assembly at a height positioning said first and second runner supports at a substantially horizontal level;

a seat assembly having a rotatable base slidably secured to said first and said second runner support, said rotatable base includes a first tube slide slidably secured to said first runner support and a second tube slide slidably secured to said second runner support, said seat assembly including a seat section and a seat back section positioned perpendicular to said seat section, said seat section and said back section are constructed of a slip resistant padding;

a seat lever operatively associated with said rotatable base, said seat lever engaging at least one spring biased pin to lock said seat section in a fixed position;

a linear actuator having a first end secured to one said elbow assembly and a second end secured to said seat assembly by a spindle, said linear actuator having a magnetic drive DC motor for deployment and retraction of said seat assembly along said first and second support runners by rotation of said spindle; and a controller for remotely operating said motor.

10. The bathtub chair according to claim 9 wherein said first and second runner supports are releasably secured to said first and second elbow assemblies by use of biased detents.

11. The bathtub chair according to claim 9 wherein said DC drive motor operates with 24V.

12. The bathtub chair according to claim 9 wherein said controller is coupled to said linear actuator by a flexible wire.

13. The bathtub chair according to claim 9 wherein said controller is wirelessly coupled to said linear actuator.

14. The bathtub chair according to claim 9 including a handle positioned adjacent to each side edge of said seat portion.

* * * * *